United States Patent [19]

Keller

[11] 4,087,882

[45] May 9, 1978

[54] APPARATUS FOR PLUCKING AND DELIVERING FIBER TO A FEEDER WITH AUTOMATIC DUST CONTROL

[75] Inventor: Alex J. Keller, Gastonia, N.C.

[73] Assignee: Automatic Material Handling, Inc., Bessemer City, N.C.

[21] Appl. No.: 758,590

[22] Filed: Jan. 12, 1977

[51] Int. Cl.[2] ..... A47L 5/00

[52] U.S. Cl. ..... 15/301; 15/319; 19/81

[58] Field of Search ..... 15/301, 319; 19/81

[56] References Cited

U.S. PATENT DOCUMENTS

| | | | |
|---|---|---|---|
| 2,924,062 | 2/1960 | Sutcliffe | 15/301 X |
| 2,976,556 | 3/1961 | Reiterer | 15/301 |
| 3,628,213 | 12/1971 | Ramo | 15/301 X |
| 3,777,908 | 12/1973 | Keller | 214/16 R |

FOREIGN PATENT DOCUMENTS

| | | | |
|---|---|---|---|
| 2,337,528 | 2/1974 | Germany | 15/301 |

*Primary Examiner*—Christopher K. Moore
*Attorney, Agent, or Firm*—Richards, Shefte & Pinckney

[57] ABSTRACT

Apparatus having an elevated trackway and a pick-up head arranged thereon for automatically plucking increments of fibers from one or more bales, delivering such increments of fiber to a position above a hopper feeder, and dropping such increments of fiber therein, all in a predetermined cycle and in response to a fiber demand signal from the hopper feeder. Such apparatus includes a suction conduit disposed above the hopper feeder and adjacent the path of travel of the fiber increments as they are dropped into the hopper feeder, with such suction conduit being connected to a continuous vacuum source. A valve is disposed in the suction conduit, and is opened when the pick-up head commences its cycle and closed when the pick-up head completes its cycle.

9 Claims, 4 Drawing Figures

APPARATUS FOR PLUCKING AND DELIVERING FIBER TO A FEEDER WITH AUTOMATIC DUST CONTROL

BACKGROUND OF THE INVENTION

In Keller U.S. Pat. No. 3,986,623, issued Oct. 19, 1976, and Keller U.S. Pat. No. 3,777,908, issued Dec., 1973, apparatus is disclosed for plucking increments of fiber from a plurality of bales arranged behind a plurality of hopper feeders, and delivering such fiber increments to the hopper feeders in a controlled, predetermined cycle. The apparatus includes a pick-up head arranged on an elevated trackway located over the plurality of hopper feeders and the bales adjacent thereto, and the control system for the pick-up head constantly monitors the plurality of hopper feeders to determine when one or more of them is generating a signal indicating that additional fiber is required by the signaling hopper feeder. When such a signal is generated by one of the hopper feeders, the pick-up head is caused to move to the signaling hopper feeder, then the pick-up head moves, in sequence, to pluck an increment of fiber from selected bales adjacent the signaling hopper feeder and to deliver each such fiber increment to a position above the hopper feeder where the fiber increment is released so that it falls into the hopper feeder.

One of the significant advantages of the aforementioned apparatus, as compared with manual feeding of fiber to the hopper feeder, is the fact that a worker need not be constantly exposed to the fiber dust that is generated when layers or fiber are separated from the bales and dumped into the hopper feeders. Nevertheless, this fiber dust still presents a less severe problem because workmen are present in the general vicinity of the aforementioned apparatus during certain times, as for exmple, when exhausted bales are replaced with new bales.

While most mills which utilize apparatus of the aforesaid type have large existing vacuum systems designed to constantly recirculate and filter air within the mill, the fiber dust nevertheless is present in the environment for a predetermined length of time before it reaches the intak of such existing vacuum systems, and small particles of fiber dust are often quite difficult to collect once they are generally propagated into the environment.

In an effort to avoid drawbacks of utilizing the existing vacuum or air cleaning systems of the mill, it has been proposed that an individual, separate vacuum system be installed at each feeder hopper for constant operation whereby fiber dust generated by the increments of fiber falling into a hopper feeder is sucked into the individual vacuum system therefor and removed before being universally propagated into the surrounding environment. Separate or individual vacuum systems of this sort would serve to reduce the amount of fiber dust in the air, but they have the disadvantage of beng expensive. If each hopper feeder is provided with its own vacuum stystem, the initial costs and the operating costs therefor are increased, and this expense can become particularly significant in installations using a large number of hopper feeders. Additionally, even if suction ducts are connected to the existing mill vacuum system and led to each hopper feeder for the usual continuous suction operation, such additional ducts would impose a significant extra load on the existing vacuum system, perhaps to the point of requiring larger suction equipment in installations having a large number of hopper feeders. Finally, such individual suction systems, or add-on ducts, would be very inefficient from an energy consumption and suction equipment utilization standpoint because, in the usual multi-hopper feeder installations, the suction systems for all of the hopper feeders would be operating constantly even though, as pointed out above, the pick-up head only delivers fiber increments to one hopper feeder at a time.

By virtue of present invention, each hopper feeder is provided with an individual suction conduit that can be connected directly to the existing mill vacuum system without imposing an undue load thereon because each suction conduit is controlled in conjunction with the operation of the pick-up head so as to create a vacuum only when the pick-up head is actually delivering fiber increments to the hopper feeder associated with such suction conduit.

SUMMARY OF THE INVENTION

In accordance with the present invention, the pick-up head is arranged on an elevated support, as described above, and is operated by a control system to carry out a predetermined fiber delivery cycle which includes delivering fiber to a position above one or more hopper feeder and dropping the fiber into such hopper feeders. A conduit is disposed at each hopper feeder adjacent the path of travel of the fibers being dropped therein, and an opening is provided in such conduit. Vacuum control means is provided for imposing a vacuum within a conduit at the beginning of the predetermined fiber delivery cycle therefor, and for discontinuing the imposition of such vacuum at the end of such predetermind fiber delivery cycle.

Thus, the present invention includes a vacuum system located immediately adjacent the point where significant quantities of fiber dust may be generated, and this system operates in conjunction with the pick-up head control system to operate the vacuum system only during the time fiber is actually being delivered to the hopper feeder with which the vacuum system is associated.

In the preferred embodiment of the present invention, the conduit extends from an existing continuous vacuum source, such as the primary suction system found in most textile mills, to an end portion located adjacent the path of travel of the fiber increments as they are dropped into the hopper feeder, with the conduit opening being located in such end portion thereof. A valve member is disposed in the conduit between the vacuum source and the end portion of the conduit, and is selectively operable to open at the beginning of the fiber delivery cycle and to close at the end of such cycle. The conduit opening is preferably located at the bottom, or at least in the lower half of the conduit so that it will not become clogged or obstructed by large particles of fiber falling into the hopper feeder, and a selectively operable damper is provided for adjusting the size of the conduit opening.

In many instances, the pick-up head will be operated to pluck fibers from a plurality of parallel rows of bales extending from the hopper feeder, and will move to a corresponding plurality of adjacent positions above the hopper feeder to drop increments of fiber onto a plurality of different portions of the hopper feeder. In such instances, a suction conduit is preferably located beneath and intermediate each two adjacent dropping positions of the pick-up head whereby each such suction conduit is disposed immediately adjacent each path of travel of the fiber increments regardless of the position of the pick-up head at the time the fiber increment is dropped.

Finally, a single pick-up head may be controlled to deliver fiber serially to a plurality of hopper feeders, and, in such instances, the present invention provides for controlling the vacuum system associated with each hopper feeder so that a vacuum is applied to the vacuum conduit of each hopper feeder during the time fiber is being delivered thereto in the aforesaid predetermined fiber delivery cycle for such hopper feeder, whereby a vacuum is imposed only at the conduit of the feeder unit to which fiber is being delivered while no vacuum is imposed at the conduits of the remaining hopper feeders.

DESCRIPTION OF THE PREFERRED EMBODIMENT

Figure 1:
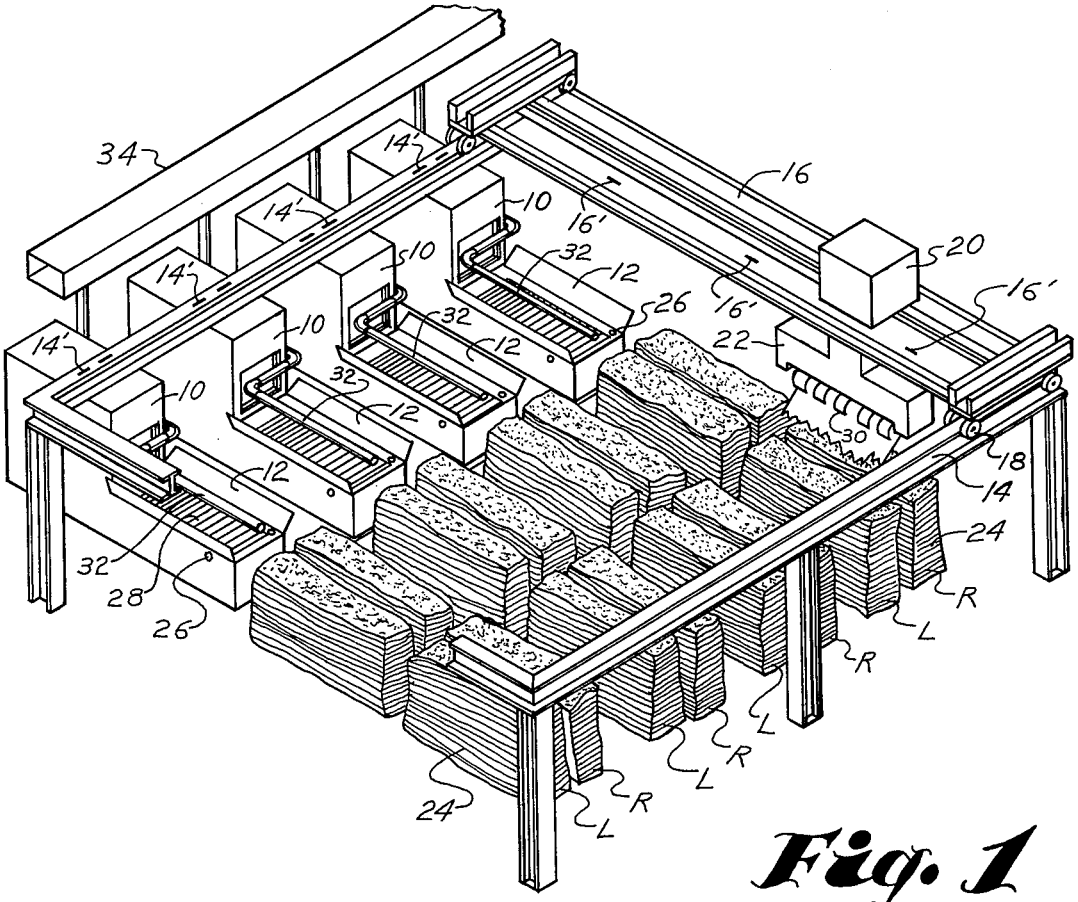
FIG. 1 is a perspective view of fiber plucking and transporting apparatus embodying the present invention.

Looking now in greater detail at the accompanying drawings, FIG. 1 illustrates the general layout of apparatus for plucking fibers from a plurality of bales and delivering such fibers to one or more of a plurality of hoppers, all as shown and described in greater detail in the aforesaid Keller U.S. Pat. Nos. 3,777,908 and 3,986,623 to which reference is made for details of the construction and operation of such apparatus.

The details of the operation of the aforesaid apparatus are not part of the present invention, it being sufficient for present purposes to summarize such operation, as follows.

As seen in FIG. 1, a plurality of hoppers 10, each provided with an extended apron or feeder 12, are disposed beneath an elevated trackway 14 on which a crane 16 is movably carried by wheels 18, the crane 16 having movably mounted thereon a dolly 20 which supports a pick-up head 22 for vertical movement with respect thereto.

Each hopper feeder 12 has extending therebehind a plurality (e.g. two) of rows of bales of fiber 24, such rows being identified as "L" for left and "R" for right. Additionally, each hopper feeder 12 is provided with a photoelectric cell 26 disposed in a side wall thereof at a predetermined height above the conveyor surface 28 for generating a signal when the fiber on the conveyor surface 28 reaches a predetermined minimum level, such signal indicating that the hopper feeder 12 requires fiber and being transmitted to a control panel (not shown).

The elevated trackway 14 is provided with a plurality of cams 14', one located behind each row of bales 24, such cams 14' being used to trip switches (not shown) on the crane 16 to position the crane 16 above any desired row of bales 24. Likewise, the crane 16 is provided with a plurality of cams 16', one located above each bale position in a row of bales 24, such cams 16' being used to trip switches (not shown) on the dolly 20 to position the dolly 20 and pick-up head 22 above any desired bale 24 in a row.

In operation, the control panel (not shown) constantly monitors the apparatus, and when the photoelectric cell 26 of one of the hopper feeders 12 generates a signal indicating that it requires additional fiber, the crane 16 is automatically moved to a position over a selected one of the bale rows behind the signaling hopper feeder 12, at which position it engages one of the trackway cams 14'. The dolly 20 is then automatically moved along the crane 16 to a position above one of the bales 24 in the selected bale as determined by crane cams 16', the pick-up head 22 is lowered to permit finger elements 30 associated therewith to grasp an increment of fiber from such one bale, and the pick-up head 22 is then raised. The dolly 20 is then automatically moved to a position above the adjacent hopper feeder 12 where the finger elements 30 are opened to release the increment of fiber and permit it to drop onto the conveyor surface 28 of the hopper feeder 12. The dolly 20 then proceeds automatically to a position above another of the bales 24, and the operation described above is repeated. As explained in greater detail in the aforesaid Keller U.S. Pat. No. 3,986,623, the control for the apparatus may be programmed so that the pick-up head 22 will pluck fibers from either or both of the bale rows "L" and "R", and from one or more of the bales 24 in each such row, depending on the preference of the operator. When the pick-up head 22 has completed plucking and delivering fiber from all of the selected bales behind a signaling hopper feeder 12 in the aforesaid preselected cycle, such cycle is completed and a signal is generated at the control panel to cause the apparatus to again resume monitoring of all of the hopper feeders 12. thus, for any particular hopper feeder 12, a first signal is generated when the photoelectric cell 26 thereof signals and one of the trackway cams 14' above such hopper feeder 12 trips a switch on the crane 14 to commence the aforementioned cycle, and a second signal is generated at the conclusion of such cycle when fiber from all selected bales has been serially plucked and delivered to the hopper feeder 12, whereby a single pick-up head 22 can sequentially supply fiber to a plurality of hopper feeders 12.

Figure 2:
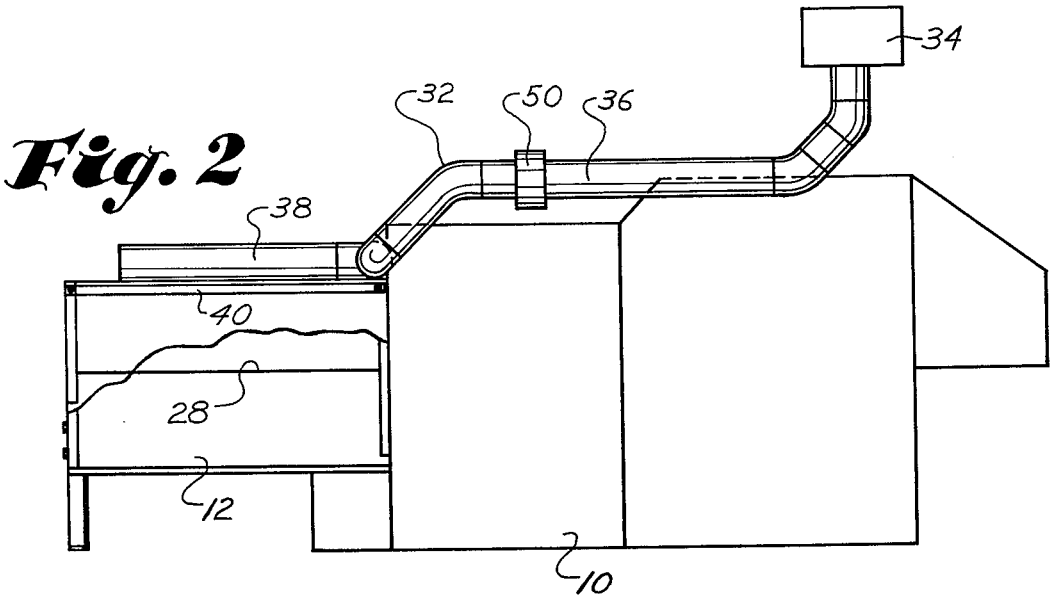
FIG. 2 is a side elevational view of one of the hoppers shown in FIG. 1.
Figure 3:
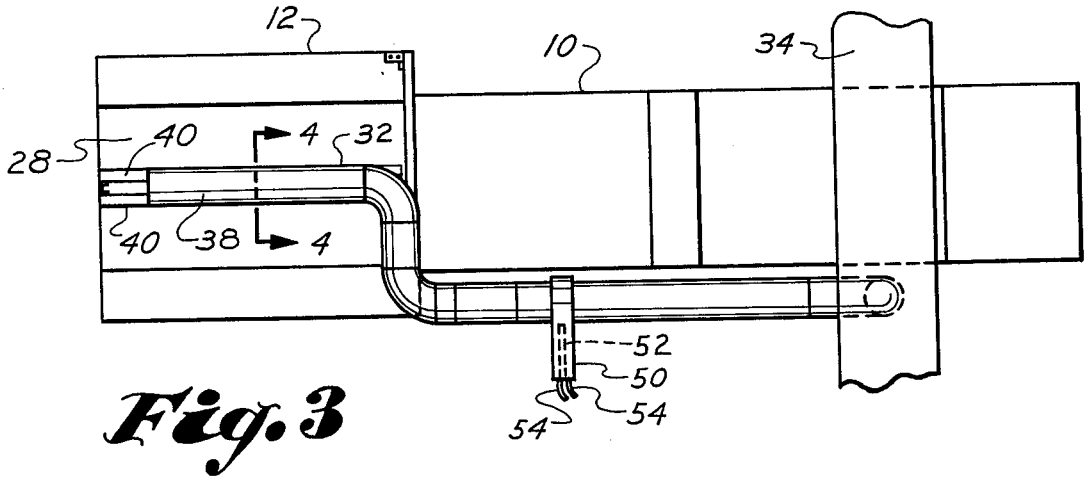
FIG. 3 is a plan view of the hopper shown in FIG. 2.

In accordance with the present invention, each hopper feeder 12 is provided with a conduit 32 having one end thereof connected to a vacuum source manifold 34 and having an intermediate portion 36 extending therefrom to an end portion 38 that is mounted directly above the conveying surface 28 of the hopper feeder 12, as best illustrated in FIGS. 2 and 3, so that such end portion 38 will be disposed immediately adjacent the vertical path of travel of the increments of fiber as they are dropped from the pick-up head 22 and onto the conveyor surface 28 when the pick-up head finger elements 30 are opened as described above. Since substantially all textile mills in which the apparatus described above will have an existing vacuum manifold 34 which connects to a variety of outlets and equipment for generally removing and/or recirculating the air in the textile mill, all of the conduits 32 of the present invention are simply connected to this existing vacuum manifold 34, without imposing any significant additional load on the existing vacuum system as will be explained in greater detail below. However, it is to be understood that the conduits 32 could be connected to other convenient vacuum sources.

Figure 4:
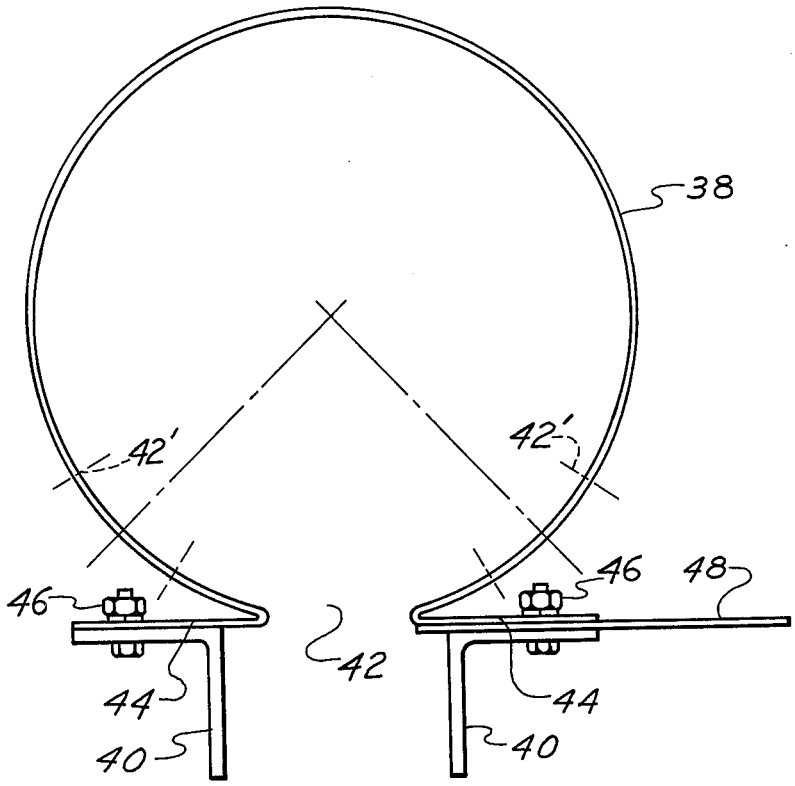
FIG. 4 is a detail view taken along line 4—4 in FIG. 3.

The conduit end portion 38 is mounted on a pair of spaced beams 40 that extend above and along the longitudinal centerline of the conveyor surface 28, and a slot or opening 42 (see FIG. 4) is provided in the conduit end portion 38 along the longitudinal extent thereof by segments 44 of the conduit end portion 38 being bent outwardly and secured, respectively, to the beams 40 by bolts 46. A flat damper plate 48 is also mounted to one of the beams 40 by bolts 46, and includes slots for receiving each bolt 46 whereby the damper plate 48 can be selectively moved, when the bolts 46 are loosened, in a horizontal direction as seen in FIG. 4 to adjust the size of the opening 42.

The intermediate conduit portion 36 has mounted therein a conventional slide valve 50 which includes a valve member 52 slidable into and out of the intermediate conduit portion by an electrical operator (not shown) connected to the aforesaid control panel by electrical lines 54. The slide valve 50 normally is at its closed position with the valve member 52 located in the intermediate conduit portion 36 whereby no vacuum is imposed within the conduit end portion 38. When, however, the aforesaid first signal occurs at the control panel as a result of one photoelectric cell 26 signaling and a corresponding trackway cam 14' tripping a crane switch as described above, valve member 50 is energized through lines 54 to cause the valve member 52 to move to its open position, outside of the intermediate conduit portion 36 so that the vacuum in the vacuum manifold 34 is imposed within the conduit end portion 38 to draw air and fiber dust entrained therein through the opening 42 for conveyance to the vacuum manifold 34. When the pick-up head 22 completes its cycle of plucking and delivering fiber increments to the hopper feeder 12, and a second signal is generated as described above, the slide valve 50 is de-energized and the valve member 52 returns to its closed position.

It will be noted that in the preferred embodiment of the present invention, the electrical signals which are used to control the movement of the pick-up head 22 through its predetermined fiber delivery cycle are also used to control the opening and closing of the slide valve 50. That is, when the pick-up head 22 reaches a signaling hopper 10 and engages a cam 14' associated therewith, a control signal is generated to cause the pick-up head 22 to begin delivering fiber to such hopper 10 in the aforesaid predetermined cycle, and this same control signal is used to open the slide valve 50 through electrical lines 54. Similarly, when the pick-up head 22 completes its predetermined fiber delivery cycle, a second control signal is generated to cause the pick-up head 22 to move away from the hopper 10, and this second control signal is also used to close the slide valve 50 through electrical lines 54 extending from the control panel of the apparatus. It will be apparent that the control of the slide valve 50 is simplified by tying its operation into the existing control system of the fiber plucking and delivery apparatus. However, it is to be understood that separate switches and control circuits could be installed on the apparatus for controlling the slide valve 50 apart from the existing control of the apparatus as a whole, as for example, by adding cams on the crane 16 which would trip slide valve control switches disposed on the pick-up head 22 when the pick-up head 22 approaches and leaves a position above a hopper 10 at which fiber is dropped into the hopper 10.

In the described apparatus, the pick-up head 22 is operated so that, during delivery of fiber to any given hopper 10, it will pluck increments of fiber from either or both bale rows "L" and "R", and it will travel along a path parallel to the bale row from which a fiber increment is plucked and drop such fiber increments onto the conveyor surface 28 of the hopper. Because the bale rows "L" and "R" are slightly spaced from one another, the pick-up head 22 will be above one side or the other of the conveyor surface 28 when fiber is dropped thereon, depending on which bale row such fiber was plucked from. By mounting the suction conduit 32 above the center of the conveyor surface 28, as described above, fibers will be dropped on either side of the suction conduit 32, depending upon which bale row was plucked, but the suction conduit will be immediately adjacent the path of travel of the fiber being dropped on the conveyor surface 28, regardless of which bale row was plucked by the pick-up head 22. If more than two bale rows are located behind a hopper 10, then more than one suction conduit 32 may be used, with each such suction conduit 32 being located between two paths of travel of the fiber as it is dropped onto a different portion of the conveyor surface 28. Moreover, rather than having only one opening at the bottom of the suction conduit 32 as shown in FIG. 4, two openings 42' may be used, each located in the lower portion of the suction conduit 32 but having center lines forming acute angles with the horizontal as shown in dotted lines in FIG. 4 whereby air and entrained dust is sucked into the conduit 32 from both sides thereof when fibers are dropped on either side of the conduit 32 as described above.

Thus, the suction conduit 32 is located adjacent to the path of travel of the fiber dropped onto the conveyor surface, but not directly in the path thereof in a position which might interfere with the fiber as it is dropped. Also, by locating the openings in the lower portion of the conduit 32, the openings themselves will not be in the path of the falling fiber and they will not become clogged or closed by such fibers.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. Apparatus for delivering fiber to a feeder unit with a minimum propagation of fiber dust, said apparatus including:

(a) an elevated support;

(b) feeder means for receiving fibers, said feeder means being disposed generally beneath said elevated support;

(c) pick-up head means for picking up and for transporting fibers, said pick-up head means being arranged on said elevated support and including means for selectively engaging and releasing increments of fiber;

(d) pick-up head control means selectively operable to cause said pick-up head means to move through a predetermined cycle which includes delivering said increments of fiber to a position above said feeder means and dropping said increment of fiber into said feeder means;

(e) a conduit disposed at said feeder means adjacent the path of travel of said increments of fiber dropped from said pick-up head means into said feeder means, said conduit having an opening therein;

(f) a vacuum source; and (g) vacuum control means selectively operable to connect said vacuum source to said conduit at the beginning of said predetermined cycle of said pick-up head means whereby a vacuum is imposed within said conduit and to disconnect said vacuum source from said conduit at the end of said predetermined cycle, whereby said vacuum will no longer be imposed within said conduit.

2. Apparatus as defined in claim 1 and further characterized in that said vacuum source is continuously operable and said conduit extends from said vacuum source to an end portion located adjacent said fiber increment path of travel, said conduit opening being located in said end portion thereof, and in that said vacuum control means includes valve means disposed in said conduit between said vacuum source and said end portion, and said valve means being selectively operable by said vacuum control means to open and to close at the beginning and end of said predetermined pick-up head means cycle, respectively.

3. Apparatus as defined in claim 1 and further characterized in that said conduit includes selectively operable damper means for adjusting the size of said conduit opening.

4. Apparatus as defined in claim 3 and further characterized in that said conduit includes selectively operable damper means for adjusting the size of said conduit opening.

5. Apparatus as defined in claim 1 and further characterized in that said pick-up head means is arranged on said elevated support for movement to a plurality of adjacent positions above said feeder means to drop said increments of fiber onto a plurality of different portions of said feeder means and in that said conduit is located beneath and intermediate each two of said adjacent positions of said pick-up head means.

6. Apparatus as defined in claim 5 and further characterized in that said conduit includes an end portion extending longitudinally above said feeder means, in that said conduit opening is located in the lower portion of said conduit end portion, and in that said conduit includes selectively operable damper means for adjusting the size of said conduit opening.

7. Apparatus as defined in claim 1 and further characterized in that a plurality of feeder means are disposed adjacent one another generally beneath said elevated support with each said feeder means having means for generating a signal when it requires additional fiber, in that said pick-up head control means is operable in response to said generated signals to move said pick-up head along said elevated support to a position above the signaling feeder means for delivering fiber thereto in said predetermined pick-up head means cycle, and in that each of said feeder means has a conduit means associated therewith which is connected and disconnected to said vacuum source during said predetermined pick-up head means cycle.

8. Apparatus as defined in claim 7 and further characterized in that a plurality of fiber bales are disposed adjacent each said feeder means at preselected bale positions beneath said elevated support, and in that said pick-up head control means is operable to cause said pick-up head means to pluck an increment of fiber from bales in one or more of said preselected bale positions and deliver such increments of fiber to a position above an adjacent feeder means during said predetermined pick-up head means cycle.

9. Apparatus for delivering fiber to a feeder unit with a minimum propagation of fiber dust, said apparatus including:

(a) feeder means for receiving fibers;

(b) a pick-up head including means for selectively engaging and releasing increments of fiber, said pick-up head being arranged on carriage means for permitting movement of said pick-up head;

(c) control means responsive to generated control signals for causing said pick-up head to move through a predetermined cycle which includes delivering said increments of fiber to a position above said feeder means and dropping said increments of fiber into said feeder means;

(d) a conduit disposed at said feeder means adjacent the path of travel of said increments of fiber dropped from said pick-up head into said feeder means, said conduit having an opening therein;

(e) a vacuum source; and (f) vacuum control means responsive to selected ones of said control signals to cause said vacuum source to be connected to said conduit during said dropping of said increments of fiber into said feeder whereby a vacuum is caused to be imposed within said conduit during said dropping, and to cause said vacuum source to be disconnected from said conduit after said increments of fiber have been dropped into said feeder means.

* * * * *